United States Patent [19]

Nunez

[11] 4,154,183

[45] May 15, 1979

[54] CHARACTER COSTUME SUBSTRUCTURE

[76] Inventor: Ralph M. Nunez, 8837 Oak Park Ave., Northridge, Calif. 91324

[21] Appl. No.: 898,622

[22] Filed: Apr. 21, 1978

[51] Int. Cl.[2] ..... A41F 19/00

[52] U.S. Cl. ..... 112/302; 2/79; 272/25

[58] Field of Search ..... 2/302, 69, 79, 78 R, 2/74, 75, 218, 223, 255, 259, 313, 314, 315, 316, 317, 1; 272/25

[56] References Cited

U.S. PATENT DOCUMENTS

| | | | |
|---|---|---|---|
| 395,189 | 12/1888 | Stanton | 272/25 |
| 560,961 | 5/1896 | Zimmerman | 2/69 |
| 770,458 | 9/1904 | Fox | 2/69 |
| 1,242,064 | 10/1917 | Spangler | 2/259 |
| 1,373,423 | 4/1921 | Gruhl | 272/25 |
| 3,611,439 | 10/1971 | Meyers | 2/74 |
| 3,693,283 | 9/1972 | Marcus | 2/75 X |

FOREIGN PATENT DOCUMENTS

| | | | |
|---|---|---|---|
| 19222 of | 1910 | United Kingdom | 272/25 |

*Primary Examiner*—H. Hampton Hunter
*Attorney, Agent, or Firm*—Gene W. Arant

[57] ABSTRACT

An actor portraying a clown, animal or the like wears a costume substructure which simulates the body proportions of a creature larger than he. A particular character costume is slipped on over the costume substructure.

The costume substructure includes a garment that is supported from the shoulders of the wearer but occupies an expanded position such that it is spaced away from his body. A frame composed of a plurality of resilient ribs arranged in a crisscrossing relationship maintains the expanded position of the garment.

15 Claims, 8 Drawing Figures

7
40a
4
42a
7
G
52
4
57a
41
40
8
8
32
30
51
56a
42
6
5
5
43
37
33
50
31
55a
6
32
10
13
11
20
12
21
22

11
12b
11a
12
56
51
31
41

42a
42b
32c

32
G
42

12a
12c
13b
12
13
32a
42
32
32b

41
G
55
50
31

10a

G
17a
10
17

CHARACTER COSTUME SUBSTRUCTURE

BACKGROUND OF THE INVENTION

It has been known for quite some time for a character actor who is portraying a clown, animal, or the like to wear a separate costume substructure to simulate the body proportions of the particular creature that is being portrayed. Then the costume whose characteristics give the appearance of the external features of the creature is slipped on over the substructure. It is therefore possible to use a single substructure with any selected one of several costumes.

It has heretofore been the practice to use some type of padding material to provide the costume substructure. For example, foam plastic has often been used in recent years.

I have observed that the costume substructures commonly in use have had many disadvantages for the actors who wore them. Air circulation was poor, resulting in excessive perspiration of the wearer. The padded suits often inhibited proper breathing of the wearer, particularly when occupying a bent or cramped position. And finally, the padded suits presented a fire hazard which I felt was unnecessary and undesirable.

The object of the present invention, therefore, is to provide a novel type of costume substructure which is economical to manufacture, comfortable for the actor to wear, and is both safe and effective when used for its intended purpose.

SUMMARY OF THE INVENTION

According to the present invention I provide a costume substructure which is essentially in the form of a hollow shell that is supported in spaced relationship to the body of the wearer. More specifically, it includes a garment that is vertically supported upon the shoulders of the wearer. The body portion of the garment would fit very loosely about the trunk of the person, but is supported by a frame structure consisting of a plurality of resilient ribs arranged in crisscrossing relationship and secured to the garment so that they maintain it in an expanded position in which it is horizontally spaced away from the wearer's body.

According to one specific feature of the invention the frame structure consists of a set of vertical ribs or stays and a set of horizontal ribs or stays, both sets of ribs or stays being fastened to the external surface of the garment.

According to another feature of the invention the garment is provided with a crotch portion, and a single resilient rib or stay is attached in vertically extending position to the front surface of the garment, underneath the crotch portion thereof, and upward along the rear surface thereof.

According to a further feature of the present invention the crisscrossing ribs or stays are not attached to each other at the crossover points, but are supported only by the material of the garment, thereby permitting the garment to adjust its silhouette to that for which it was designed.

According to yet a further feature of the present invention the garment is made of a plurality of gores which are sewn together along substantially vertical seams, and a separate rib or stay is secured to the garment along each of the seams, thereby supporting each of the gores from both of its longitudinal edges.

DRAWING SUMMARY

GENERAL ARRANGEMENT

Figure 1:
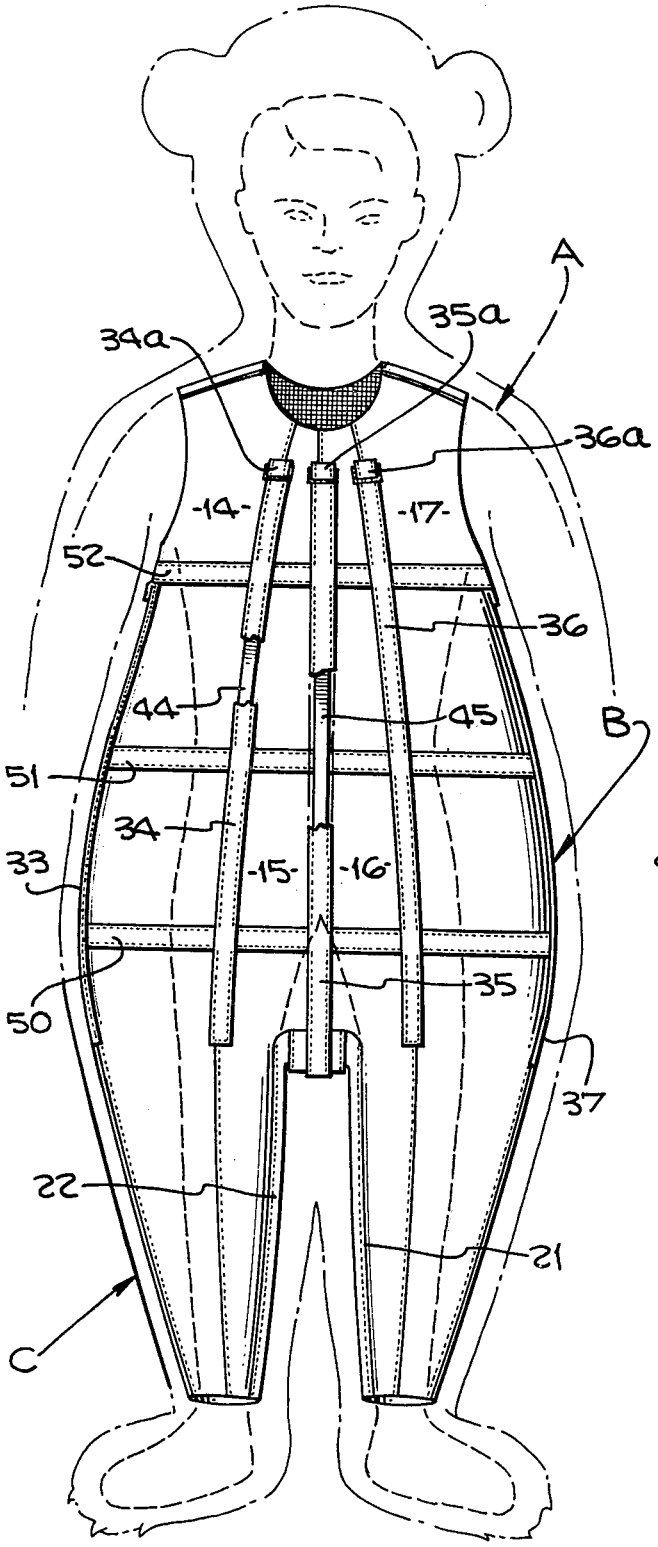
FIG. 1 is a front elevation view of an actor wearing a costume substructure in accordance with the present invention, and also wearing a character costume over the substructure.
Figure 2:
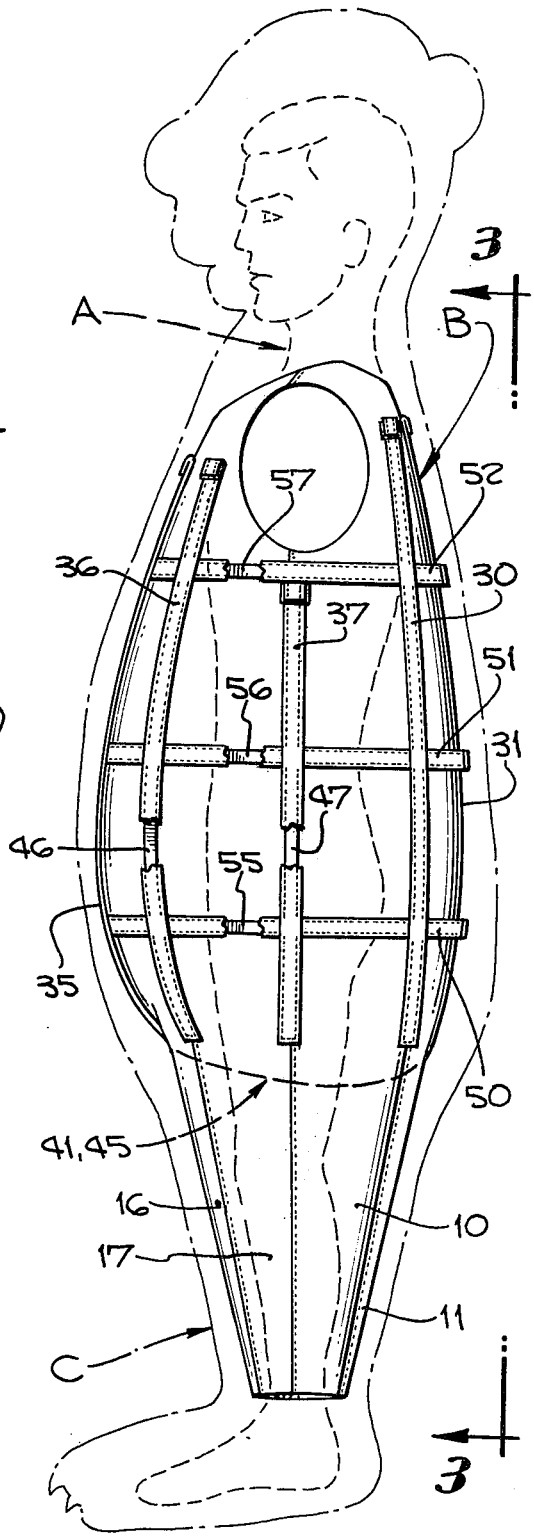
FIG. 2 is a side elevation view of the actor, substructure, and costume of FIG. 1.
Figure 3:
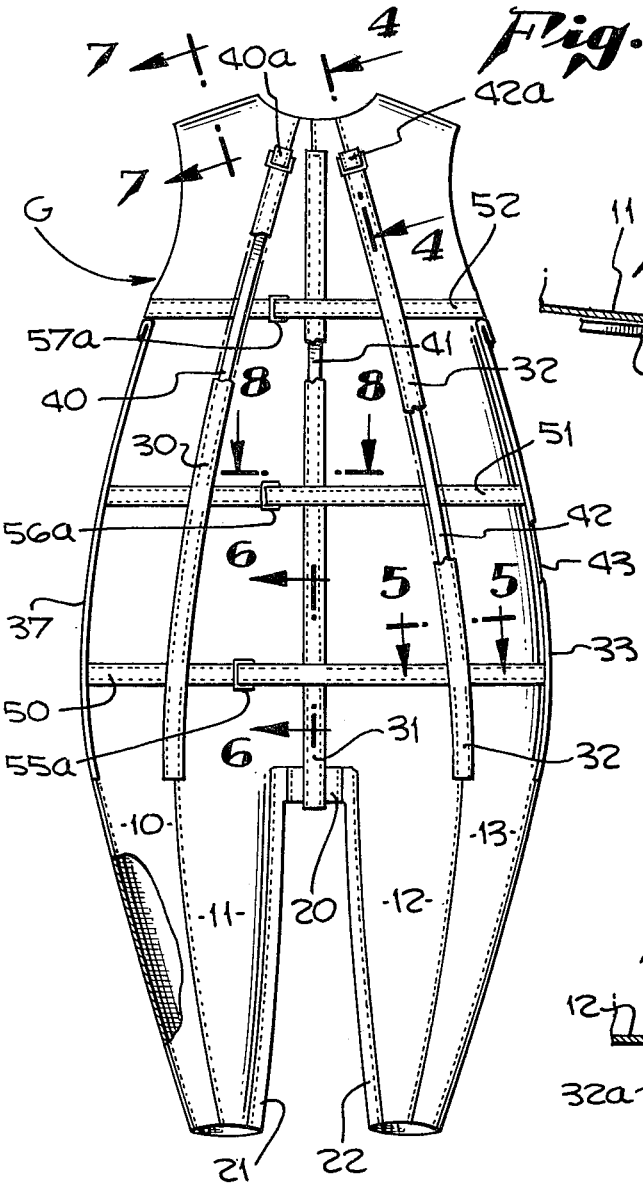
FIG. 3 is a rear elevation view of the costume substructure taken on the line 3—3 of FIG. 2, with certain parts being shown cut away or in cross-section.

Reference is made to FIGS. 1–3, inclusive, which illustrate the general arrangement of the present invention.

In FIGS. 1 and 2 a man A is shown wearing a costume substructure B in accordance with the present invention. A separate character costume C is also worn over the substructure.

Costume substructure B includes a garment G having a number of casings or carriers on its external surface, which receive corresponding ribs or stays for supporting the garment in an expanded position. A number of fasteners are also attached to the garment, some being used for closing the shoulder flaps of the garment itself, and others being used for closing the ends of the channels or casings so that the ribs or stays will be securely retained within them.

SPECIFIC STRUCTURE

Garment G is made of eight separate gores or fabric sections identified by numerals 10 to 17, inclusive, which are arranged in vertically extending positions with their joining edges being sewn together. Vertical stays or ribs 40 to 47, inclusive, are supported on corresponding ones of the garment seams, being retained within channels or casings 30 to 37, respectively.

Garment G also includes a gusset 20 forming a crotch portion, and separate leg panels 21, 22 which are attached to gusset 20 and depend downwardly from it. Thus the garment has a left-hand leg portion which, as best seen in FIG. 3, is formed by the gores 10, 11, 16, 17 and leg panel 21. It also has a right-hand leg portion formed by the gores 12, 13, 14, 15 and leg panel 22.

Figure 7:
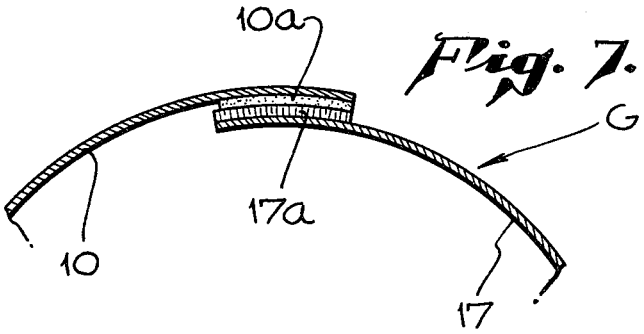
FIG. 7 is a detailed cross-sectional view taken on the line 7—7 of FIG. 3.

It will be seen that garment G has two shoulder portions, one formed by the overlapping ends of the gores 13 and 14, and the other by the overlapping ends of the gores 10 and 17. FIG. 7 shows how the overlapping ends are fastened. A standard Velcro fastener has one part **10*a* which is secured to the under surface of the upper end of gore 10, and another part 17*a* which is secured to the outer surface of the upper end of gore 17. While FIG. 1 shows the two parts of the fastener in their non-engaged position, it will be understood that the end flap of gore 10** is pressed down for engaging the two parts of the fasteners securely together. The two such fasteners used in the two shoulder portions of the garment have sufficient strength to support the garment vertically, including the two sets of stays or ribs that it carries.

The garment G also carries a set of three horizontal channels or casings 50 to 52, inclusive, which receive corresponding ones of the horizontal ribs or stays 55 to 57, respectively.

Figure 5:
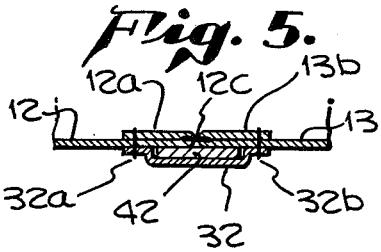
FIG. 5 is a detailed cross-sectional view taken on the line 5—5 of FIG. 3.

FIG. 5 illustrates the specific manner in which the gores are sewn together and the corresponding vertical stay is supported on the seam. The edges of the adjoining gores 12 and 13 are turned up about half or three-quarters of an inch, and are sewn together along a seam 12*c* which extends the full length of both gores. Then the raw edges 12*a*, 13*b* of the respective gores are turned back over the main portions of the cloth material. Then a casing or carrier 32 is placed over the external surface of the seam. Casing 32 is simply a strip of cloth whose width is slightly greater than the combined widths of the raw edges 12*a* and 13*b*. A seam 32*a* is sewn along one edge of casing 32 in order to fasten that casing both to the gore 12 and to the outermost part of the edge section 12*a*. A seam 32*b* is sewn along the other edge of casing 32 so as to fasten it to the gore 13 along with the gore section 13*b*. Since casing strip 32 is wider than the gore edges 12*a* and 13*b* combined, it remains loose in its central part and not held tightly against the seam 12*c*. Therefore, the rib or stay 42 may subsequently be inserted into the space between casing 32 and the garment, by a longitudinal sliding insertion movement.

Figure 4:
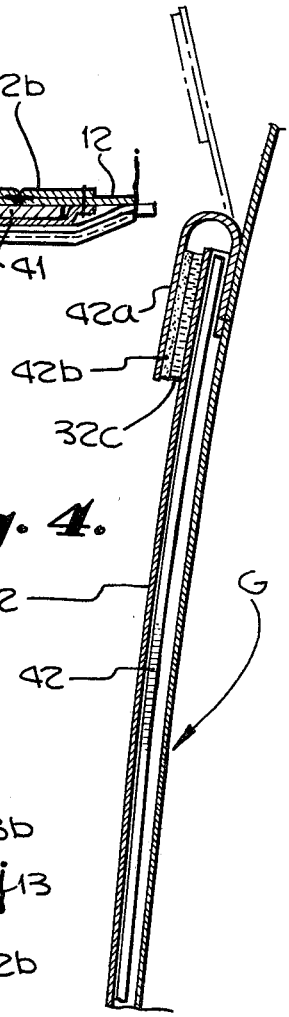
FIG. 4 is a detailed cross-sectional view taken on the line 4—4 of FIG. 3.

FIG. 4 shows another detail relating to the vertical stays or ribs. The rib casing 32 terminates some distance below the neckline of garment G, such as about two or three inches. A short strip of cloth 42*a* has one end sewed to garment G underneath the upper extremity of casing 32, whose edges are also sewed over the edges of the strip 42*a*. The remainder of strip 42*a* is available to bend over the upper end of casing 32, serving as a closing flap. A standard Velcro fastener is employed to fasten the closing flap 42*a* to the casing 32. One part 42*b* of the fastener is secured to the inner surface of flap 42*a* while the other part 32*c* is secured to the exterior surface of casing 32. After the longitudinal downward insertion of the rib 42 has been completed, flap 42*a* is folded over the casing 32 and secured by means of the fastener.

Figure 6:
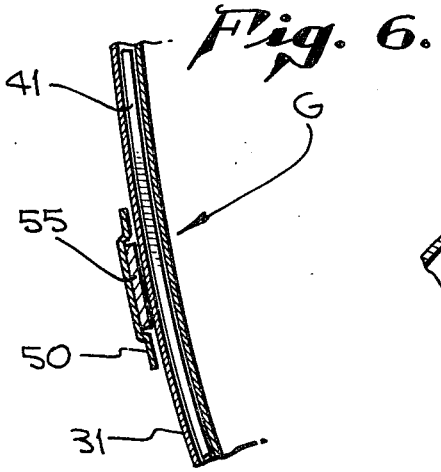
FIG. 6 is a detailed cross-sectional view taken on the line 6—6 of FIG. 3.

A detail of the horizontal ribs or stays is shown in FIG. 6. The vertical stay 41 occupies casing 31 in the lateral center of the back side of garment G. The horizontal casings and the ribs which they contain extend underneath all the other vertical stays (see FIGS. 1–3) but extend over the stay 41 and its casing 31. FIG. 6 shows a cross-section of the lowermost one of the horizontal casings 50 together with its corresponding stay or rib 55. The horizontal casing 50 is not sewed to the lateral center of vertical casing 51, because if a seam were also made through garment G it would interfere with the insertion of the vertical rib 41 into the vertical casing 31. However, as seen in FIG. 3, casing 50 is sewed down on both lateral sides of the vertical casing 31.

Figure 8:
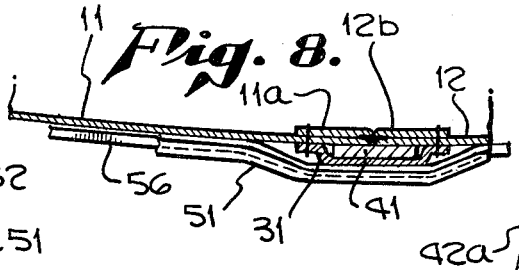
FIG. 8 is a detailed cross-sectional view taken on the line 8—8 of FIG. 3.

The crossover of vertical and horizontal ribs is seen from a different vantage point in FIG. 8. Horizontal casing 51 containing the horizontal rib 56 extends over the exterior surface of vertical casing 31 that contains vertical rib 41. Horizontal casing 51 is sewed to garment G on both sides of the vertical casing.

Each of the horizontal stays 55, 56, 57 forms a complete loop about the garment G. It has overlapping ends which are secured together on the rear side of the garment by means of a Velcro fastener. Thus as shown in FIG. 3 the overlapping ends of the stay 55 are secured by fastener 55*a* located between the vertical casings 30 and 31; and the horizontal stays 56 and 57 are secured at their overlapping ends by similar fasteners 56*a* and 57*a*, respectively, which are similarly located.

It will be noted that all of the vertical stays extend downward to about the elevation of the crotch portion of the garment. The three vertical stays on the front of the garment and the three vertical stays on the back extend upward to about two or three inches below the neckline. On the sides of the garment, however, the stays 37 and 43 terminate immediately below the uppermost one of the horizontal stays 57 and its channel or casing 52. The reason is that to extend the side stays further upward would interfere with the arm movements of the wearer and might result in injury under his armpits.

While the vertical stays 41 and 45 have previously been described as two separate entities, it is in fact preferred that they be a single unitary structure. For this purpose the casing 35 extends continuously along the underside of the crotch gusset 20 to join the casing 31 on the rear side of the garment, so that in fact these two casings are made from a single strip of material. The upper end of casing 31 on the backside of garment is sewed to the garment and does not have an opening. There is an opening on the upper end of casing 35 on the front side of the garment, which is closed by an associated flap 35*a* and secured by a Velcro fastener. Thus the rib 41, 45 is a single rib which is inserted downwardly at the front of the garment, and bends as it passes through the crotch portion and then moves upward along the rear side of the garment. When it is fully inserted the flap 35*a* is closed. The passage of this rib along the crotch section of the garment is shown in FIG. 2 by the dotted line 41, 45.

FABRICATION

The garment G is fabricated by first cutting the gores 10 to 17, inclusive, together with the crotch gusset 20 and leg panels 21, 22. These are also sewn together as shown in the drawings and as described above. The Velcro fasteners are added at the shoulder portions of the garment. Then the casings for the vertical and horizontal stays are cut, as well as their closing flaps. Fasteners are placed upon the ends of the casing strips and upon the closing flaps, as needed. Then the casing strips and closing flaps are sewed to the garment.

The final step is to insert the stays in longitudinal sliding motion and then close and fasten the flaps which secure them in place.

It is essential that both the vertical and horizontal stays be made of a resilient material which is capable of regaining its original flat configuration after it has been bent. For this purpose I prefer to use a relatively light spring steel member. Certain types of plastic material may be used to form these stays, but it is believed that the useful life of such stays would be much shorter than when made of spring steel.

METHOD OF USE

The actor simply steps into the garment G, pulls the shoulder portions up over his shoulders and then fastens the overlapping ends. As shown in FIGS. 1 and 2 a substantial space then remains in the horizontal plane between the body of man A and the garment and rib structure of the costume substructure B. The actor then selects a particular character costume which is put on over the substructure of the present invention.

When the costume substructure of the present invention is not being used, the stays are removed and laid out in a flat condition, and the garment is also folded up and may be stored in a flat condition. The garment may be washed or cleaned as needed. The stays are replaced when the costume substructure is to be used again.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A substructure for a character costume, comprising:

a garment adapted to fit very loosely about the body of a wearer and to be supported from his shoulders, said garment having leg portions and a crotch portion;

a set of elongated resilient vertical stays secured to the body portion of said garment in horizontally spaced positions thereon; and a set of elongated resilient horizontal stays secured to the body portion of said garment in vertically spaced positions thereon, and each extending completely about said garment;

said two sets of stays together supporting the body portion of said garment in an expanded position spaced away from the body of the wearer, thereby simulating a creature of larger body proportions.

2. A costume substructure as claimed in claim 1 wherein said garment is made from a plurality of vertically extending gores which are sewed together along vertically extending seams, and wherein each of said vertical stays is secured to the exterior surface of said garment along one of said seams.

3. A costume substructure as claimed in claim 2 wherein there are eight of said gores and eight of said vertical stays, two of said stays and their accompanying seams being on respective lateral sides of said garment.

4. A costume substructure as claimed in claim 3 which further includes a gusset forming said crotch portion of said garment, and having a single stay member which provides one of said vertical stays in the front central portion of said garment and extends in curved relationship along said gusset portion and hence up the rear side of said garment to provide one of said stays on the rear side thereof.

5. A costume substructure as claimed in claim 1 which includes a plurality of strips of material disposed on the exterior surface of said garment, each strip having both of its edges sewn to said garment with the intervening portion of the strip hanging from said garment in a loose relationship, each of said strips providing a channel which receives a corresponding one of said stays.

6. A costume substructure as claimed in claim 1 which further includes channel means on the exterior surface of said garment for receiving said stays in supporting relationship to said garment, said vertical stays and horizontal stays being free to slide longitudinally relative to each other within their corresponding channels.

7. A costume substructure as claimed in claim 1 which includes channel means on the exterior surface of said garment for receiving corresponding ones of said stays; said garment having a neckline and armholes, said vertical stays including a plurality on the front side of said garment which extend up near the neckline and a plurality on the backside of said garment which extend up near the neckline, and one vertical stay on each lateral side edge of said garment which extends only up nearly to the corresponding armhole.

8. A costume substructure as claimed in claim 7 wherein all of said vertical stays pass over the exterior surfaces of said horizontal stays, except for a vertical stay at the center of the backside of said garment which passes underneath said horizontal stays.

9. A character costume comprising:

a substructure garment having upper front and rear portions which overlap each other on the shoulders of the wearer so as to provide armholes and a neck opening, said garment being of sufficient size in the horizontal plane to hang very loosely about the body of the wearer;

means for detachably fastening said overlapping shoulder portions of said garment together, thereby to support said garment from the shoulders of the wearer;

a plurality of horizontal stays and a plurality of vertical stays secured to said garment in crisscrossing relationship, said stays being resiliently deformable so as to support said garment in an expanded relationship spaced away from the body of the wearer; and a costume garment worn over said substructure garment, and also worn over the arms and head of the wearer, said costume garment having an external appearance simulating that of a particular creature being portrayed.

10. A substructure for a character costume, comprising:

a garment adapted to fit very loosely about the body of a wearer and to be supported from his shoulders, said garment having leg portions and a crotch portion, and including a gusset forming said crotch portion;

a set of elongated resilient vertical stays secured to the body portion of said garment in horizontally spaced positions thereon;

a set of elongated resilient horizontal stays secured to the body portion of said garment in vertically spaced positions thereon, and each extending completely about said garment;

said two sets of stays together supporting the body portion of said garment in an expanded position spaced away from the body of the wearer, thereby simulating a creature of larger body purportions; and said garment having a single stay member which provides one of said vertical stays in the front central portion of said garment and extends in curved relationship along said gusset portion and hence up the rear side of said garment to provide one of said stays on the rear side thereof.

11. A costume substructure as claimed in claim 10 wherein said garment is made from a plurality of vertically extending gores which are sewed together along vertically extending seams, and wherein each of said vertical stays is secured to the exterior surface of said garment along one of said seams.

12. A costume substructure as claimed in claim 10 which includes a plurality of strips of material disposed on the exterior surface of said garment, each strip having both of its edges sewn to said garment with the intervening portion of the strip hanging from said garment in a loose relationship, each of said strips providing a channel which receives a corresponding one of said stays.

13. A costume substructure as claimed in claim 10 which further includes channel means on the exterior surface of said garment for receiving said stays in supporting relationship to said garment, said vertical stays and horizontal stays being free to slide longitudinally relative to each other within their corresponding channels.

14. A costume substructure as claimed in claim 10 which includes channel means on the exterior surface of said garment for receiving corresponding ones of said stays; said garment having a neckline and armholes, said vertical stays including a plurality on the front side of said garment which extend up near the neckline and a plurality on the backside of said garment which extend up near the neckline, and one vertical stay on each lateral side edge of said garment which extends only up nearly to the corresponding armhole.

15. A costume substructure as claimed in claim 13 wherein all of said vertical stays pass over the exterior surface of said horizontal stays, except for a vertical stay at the center of the backside of said garment which passes underneath said horizontal stays.

* * * * *